US007140316B2

(12) United States Patent
McIntire

(10) Patent No.: US 7,140,316 B2
(45) Date of Patent: Nov. 28, 2006

(54) BOAT DRAIN VALVE

(75) Inventor: Homer M. McIntire, Hermitage, TN (US)

(73) Assignee: Triton Boat Company, L.P., Ashland City, TN (US)

( * ) Notice: Subject to any disclaimer, the term of this patent is extended or adjusted under 35 U.S.C. 154(b) by 0 days.

(21) Appl. No.: 10/845,274

(22) Filed: May 13, 2004

(65) Prior Publication Data

US 2005/0252435 A1 Nov. 17, 2005

(51) Int. Cl.
*B63B 13/00* (2006.01)

(52) U.S. Cl. ..... 114/183 R; 114/197

(58) Field of Classification Search ..... 114/183 R, 114/184, 185, 197, 198, 360
See application file for complete search history.

(56) References Cited

U.S. PATENT DOCUMENTS 1,866,643 A * 7/1932 Greear ..... 114/197
2,431,527 A * 11/1947 Walters ..... 137/343
3,679,170 A * 7/1972 Bernas et al. ..... 251/104
4,162,690 A * 7/1979 Anderson ..... 137/385
4,817,663 A * 4/1989 McAndrew ..... 137/385
5,482,251 A * 1/1996 Roberts ..... 251/288
6,338,309 B1 * 1/2002 Michelson ..... 114/183 R
6,477,971 B1 * 11/2002 Green ..... 114/197
6,484,657 B1 * 11/2002 Donovan et al. ..... 114/201 R
6,634,312 B1 * 10/2003 Warner et al. ..... 114/197

FOREIGN PATENT DOCUMENTS

GB 2379417 A * 3/2003
JP 61169609 A * 7/1986
JP 11043094 A * 2/1999

* cited by examiner

*Primary Examiner*—Ajay Vasudeva
(74) *Attorney, Agent, or Firm*—Luedeka, Neely & Graham, P.C.

(57) ABSTRACT

A boat drain valve which incorporates a valve to open and close the drain valve. The drain valve is connected to the boat hull in a manner that provides a straight channel through the drain valve. A handle with an extension positions the grip of the handle in a location where it can be easily accessed. The grip can be positioned above operational equipment in a compartment formed by the hull of the boat and an access hatch, just under the hatch. The grip can be positioned just above the deck surface of the boat.

4 Claims, 6 Drawing Sheets

BOAT DRAIN VALVE

FIELD

This invention relates to the field of drain plugs for boats and watercraft. More particularly, this invention relates to boat drain plugs that are opened and closed by mechanical linkage.

BACKGROUND

Many boats, especially boats that are transportable on trailers, have a drain hole in or near the bilge to permit removal of water that accumulates during the normal operation of the boat. The boat is typically designed so that when the boat is removed from the body of water, the drain hole can be opened and water that has accumulated in the hull drains out.

Typically, the mechanism for controlling flow through the drain hole is a plug or stopper which is inserted in the drain hole to restrict the in-leakage of water when the boat is afloat on a body of water. One difficulty with existing systems is that if the boat operator fails to properly insert the plug before launching the boat it is generally very difficult to correct that problem while the boat is afloat. Typically the boat must be removed from the water so that the plug can be re-inserted.

In normal operation of a boat it is commonplace for material such as leaves, twigs, paper and plastic material, and other debris to accumulate in the bilge area and other areas in the bottom of a boat. Such debris can impede or block the flow of water through the drain hole when it is opened to drain the water.

What is needed therefore is a quick, inexpensive, and reliable means for closing the drain hole in a boat without removing the boat from the water, while still providing a clear, unobstructed passage for cleaning the drain hole if debris accumulates in it.

SUMMARY

With regard to the above, one embodiment provides a boat drain valve that includes a boat hull having an exterior surface and an interior surface and a generally straight hull orifice from the exterior surface to the interior surface. The hull orifice has a longitudinal orifice axis. A valve having a generally straight valve throat with a passageway and a longitudinal throat axis is also provided. The valve has a valve barrier proximal to the valve throat and the valve barrier has an open position and a closed position such that when the valve barrier is in the open position, the passageway passes water and when the valve barrier is in the closed position the passageway is substantially water tight. A valve actuator is linked to the valve barrier whereby the valve actuator switches the valve barrier to and from the open position and the closed position. A handle having a substantially inverted "L shape," is also provided. The handle includes an extension and a grip, with the extension having a proximal end, a length, and a distal end. The proximal end of the extension is attached to the valve actuator and the grip is attached to the distal end of the extension. A fastening system provides a water leak proof connection between the valve and the hull orifice. The fastening system holds the straight hull orifice and the and the straight throat passageway in general alignment whereby the hull orifice and the fastening system and the throat passageway form a substantially straight channel through the boat hull.

An alternative embodiment provides a boat drain valve system that includes a boat hull having an exterior and an interior surface and a generally cylindrical hull orifice from the exterior surface to the interior surface. A compartment is provided. The compartment has a bottom and sides that are formed substantially by the boat hull and has a deck on top. The compartment has an access provided through a hatch on the deck, and the hatch has a bottom surface exposed to the compartment. Operational equipment is disposed in the compartment. A valve is also provided, the valve having a valve throat with a passageway and a valve barrier proximal to the valve throat. The valve barrier has an open position and a closed position such that when the valve barrier is in the open position the passageway passes water and when the valve barrier is in the closed position the passageway is substantially water tight. A fastening system having an aperture is provided. The fastening system provides a water leak proof connection between the valve and the hull orifice. A valve actuator is linked to the valve barrier whereby the valve actuator switches the valve barrier to and from the open position and the closed position. A handle is included. The handle has an extension and a grip, with the extension having a proximal end, a length, and a distal end. The proximal end of the extension is attached to the valve actuator and the grip is attached to the distal end of the extension. The length of the extension is sufficient to position the grip at a point above the operating equipment such that the operating equipment does not mechanically interfere with the grip as the valve barrier is changed from the open position to the closed position, and where the grip is below the bottom surface of the hatch.

In a different embodiment a boat drain valve system includes a boat hull having an exterior and an interior surface and a generally cylindrical hull orifice from the exterior surface to the interior surface. A deck is set in the boat hull where the deck has a top surface and an access port. A valve having a valve throat with a passageway and a valve barrier proximal to the valve throat is also provided. The valve barrier has an open position and a closed position such that when the valve barrier is in the open position the passageway passes water and when the valve barrier is in the closed position the passageway is substantially water tight. The boat drain valve system also includes a fastening system that incorporates an aperture and provides a water leak proof connection between the valve and the hull orifice. There is a valve actuator linked to the valve barrier whereby the valve actuator switches the valve barrier to and from the open position and the closed position. A handle having a substantially inverted "L shape" is also included. The handle has an extension and a grip. The extension has a proximal end and a distal end and the proximal end of the extension is attached to the valve actuator and the grip is attached to the distal end of the extension. The extension passes through the access port and positions the grip at a point above the top surface of the deck.

A further alternative embodiment provides a boat drain valve having a drain hole coupling. The drain hole coupling has a cylinder with a flange at one end and an opposing distal end. The cylinder also has a conduit and an exterior wall with threads fabricated on the exterior wall. The threads extend from the distal end of the cylinder to a point near the flange. A nut having a contact side and a back side is provided. The nut is configured so that the contact side of the nut is first screwed onto the threads on the exterior wall of the cylinder leaving an engageable length of threads on the exterior wall from the back side of the nut to the distal end of the cylinder. A ball valve having a threaded valve end, a throat with a passageway, and a ball with a straight borehole through the ball is also provided. The borehole has an operational position that includes an open position and a closed position established by a ball actuator rotating the ball in a throat in the ball valve. The threaded valve end of the ball valve is threaded onto the engageable length of threads on the exterior wall at the distal end of the cylinder such that the conduit and the throat passageway create a drain valve channel. A handle having a substantially inverted "L shape" is included in the system. The handle has an extension and grip, with the extension having a proximal end, a length, and a distal end. The proximal end of the extension is attached to the ball actuator and the grip is attached to the distal end of the extension.

One advantage of embodiments of this invention is the ability to close the drain valve from inside the boat. Also, in some embodiments, when the boat drain valve is open the drain valve provides a straight channel through the hull, which is a very beneficial feature. Channels that have turns or constrictions provide locations where debris can accumulate and block the flow of water. A straight passage also facilitates unclogging the drain hole if debris should accumulate. Another advantage in some embodiments is that it is easy to determine the operational position of the ball valve by simple observation of an indicator arrow.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
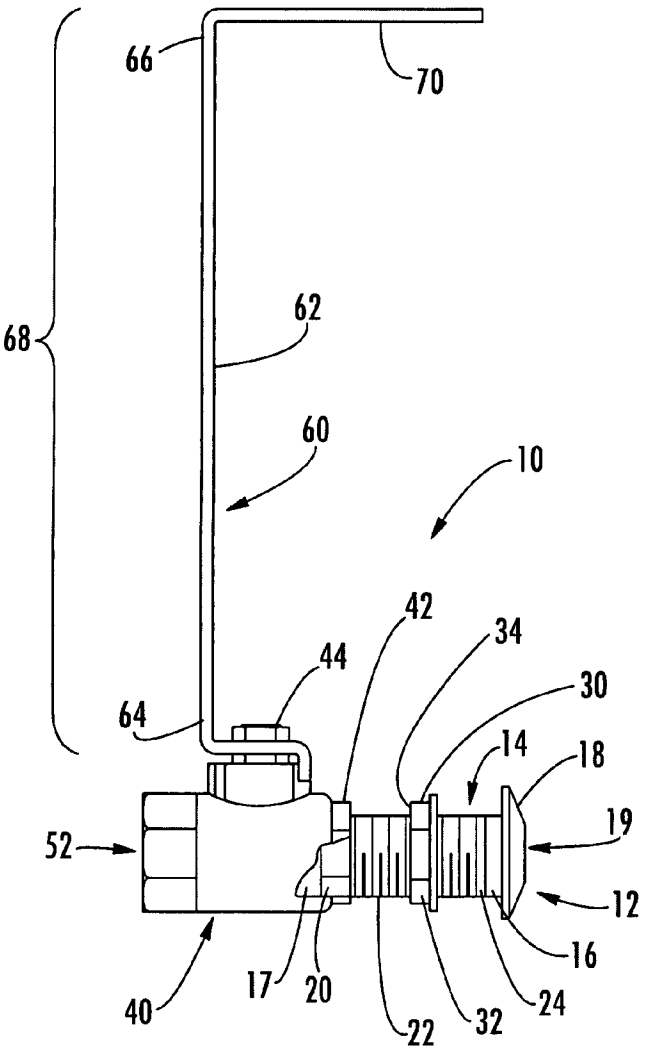
FIG. 1 is an elevational view of one embodiment of a boat drain valve according to the invention.

With reference now to FIG. 1, a boat drain valve, in this embodiment drain valve 10, is depicted. Drain valve 10 has a drain hole coupling 12 that has a cylinder 14 with a flange 18 at one end and an opposing distal end 20. Cylinder 14 also has an exterior wall 16, and an interior wall 17 that forms a coupling conduit 19. A portion of the exterior wall 16 of cylinder 14 is fabricated with external threads 22. The threads 22 extend from the distal end 20 of cylinder 14 to a point 24 near flange 18. In this embodiment cylinder 14 is a right, straight cylinder and flange 18 is perpendicular to cylinder 14. A nut 30 is threaded onto the threads 22. As seen in FIG. 1 it is important that the length of the drain hole coupling 12 and the width of nut 30 be dimensioned cooperatively such that after the nut 30 is threaded onto threads 22, a sufficient engageable length of threads 22 remain at the distal end 20 of cylinder 14 to permit ball valve 40 to be tightly affixed to the drain hole coupling 12, as next described.

Continuing with FIG. 1, a ball valve 40, having a threaded end 42 is threaded onto the threads 22 of drain hole coupling 12. Ball valve 40 has a ball actuator 44 which, as will be discussed later, opens and closes a drain valve channel 52 through drain valve 10. A handle 60 has an extension 62 and a grip 70. Extension 62 has a proximal end 64 and a distal end 66. The proximal end 64 is attached to the ball actuator 44 and the grip 70 is attached to the distal end 66 of the extension 62. The handle 60 forms a inverted "L" shape. Typically extension 62 has a length 68 from about six inches to eighteen inches.

Figure 2:
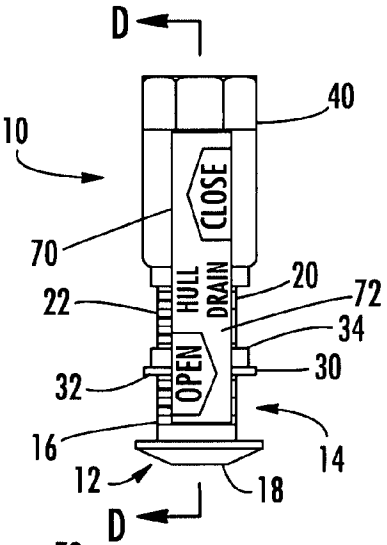
FIG. 2 is a top view of one embodiment of a boat drain valve in the open position according to the invention.

Some embodiments incorporate features depicted in FIG. 2. As will be described in further detail later, a drain valve 10 may be configured in two operational conditions: an open position and a closed position. This top view of drain valve 10 depicts a position indicator 72 which indicates whether the drain valve 10 is in the open position or the closed position. In FIG. 2 the drain valve 10 is in the open position.

Figure 3:
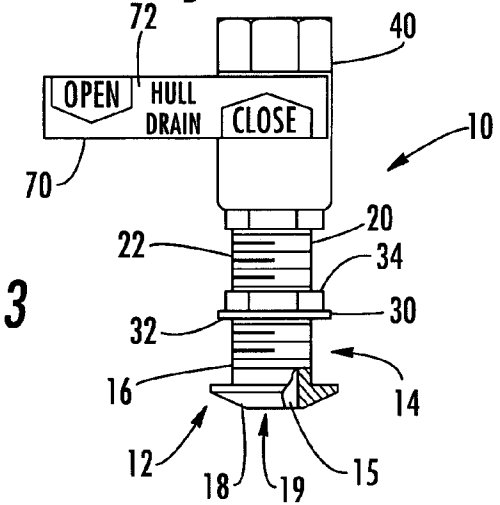
FIG. 3 is a top view of one embodiment of a boat drain valve in the closed position according to the invention.

FIG. 3 depicts drain valve 10 in the closed position. Also depicted in FIG. 3 in a partial cut-away section in FIG. 3 is an optional gripper 15 that extends into coupling conduit 19. Optional gripper 15 facilitates the threading of coupling 12 into the threaded end 42 of ball valve 40. Preferably, gripper 15 is designed to be small enough that even if more than one gripper 15 is installed in coupling conduit 19, coupling conduit 19 forms a generally unobstructed channel.

Figure 4:
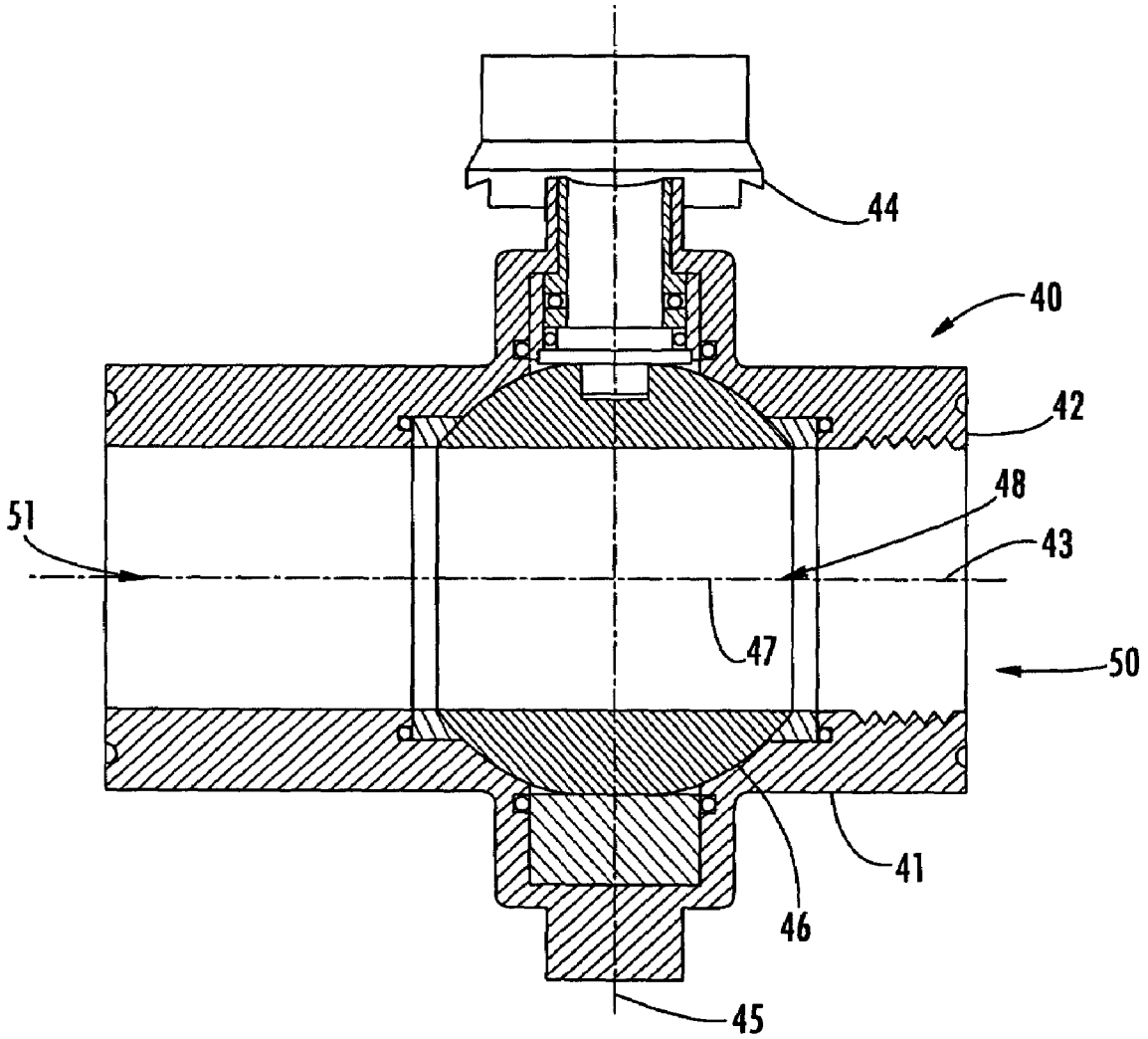
FIG. 4 is a cross section of one embodiment of a ball valve for a boat drain valve according to the invention.

FIG. 4 is a cross sectional view of ball valve 40 taken through section A—A depicted on FIG. 2. Ball valve 40 has a housing 41 with a threaded end 42 and a throat 50. Throat 50 has a throat passageway 51. In this embodiment, housing 41 of ball valve 40 is seen to be a right, straight cylinder. The threaded end 42 of ball valve 40 is seen to define a throat axis 43 through the housing 41 of ball valve 40. A valve barrier ball 46 has a cylindrical borehole 48 through a ball flow axis 47. Ball actuator 44 is attached to ball 46 and ball actuator 44 has an actuating axis 45. Ball flow axis 47 is on the same plane as the throat axis 43 through the housing 41 of ball valve 40, and ball flow axis 47 is perpendicular to actuating axis 45. When ball actuator 44 is rotated, ball 46 is rotated around actuating axis 45. Thus, ball actuator 44 can be used to open and close throat passageway 51 in ball valve 40. In FIG. 4, ball 46 with borehole 48 is shown in an operational position termed an open position. The open position is also shown in FIG. 2. When ball 46 with borehole 48 is in the open position, throat passageway 51 is straight and unobstructed through ball valve 40. Furthermore, in embodiments where both cylinder 14 of drain hole coupling 12 and housing 41 of ball valve 40 are straight cylinders, drain valve channel 52 (FIG. 1) though drain valve 10 is a straight channel when the ball 46 with borehole 48 is in the open position. When grip 70 (FIG. 3) is rotated to the position shown in FIG. 3, the ball flow axis 47 of cylindrical borehole 48 is rotated 90 degrees, thereby closing throat passageway 51, defining an operational position that is termed a closed position.

Figure 5:
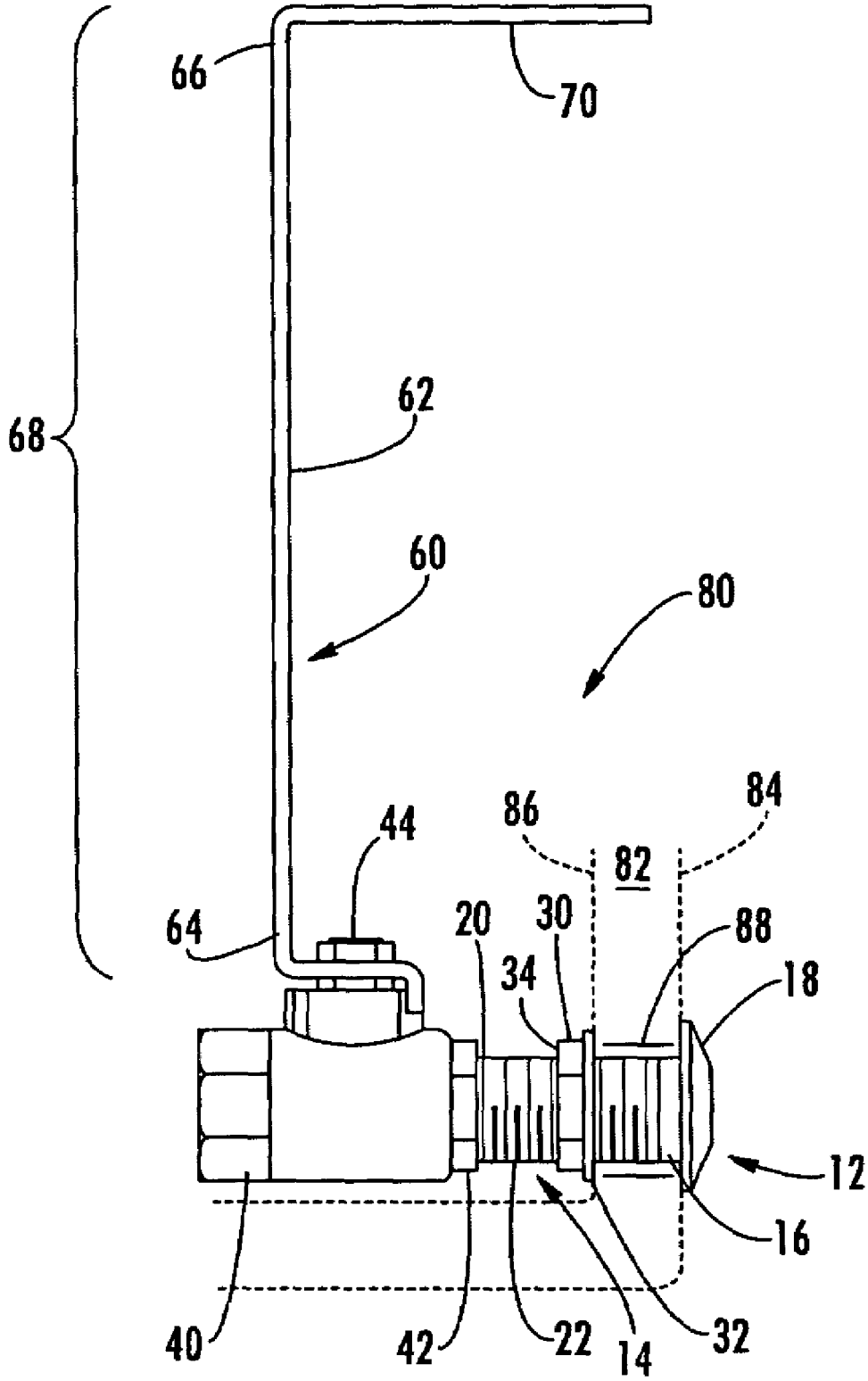
FIG. 5 is an elevational view of an alternate embodiment of a boat drain valve according to the invention.

FIG. 5 depicts an alternate embodiment of a boat drain valve, specifically hull drain valve 80. A portion of a boat hull 82 is shown, having an exterior surface 84 and an interior surface 86. A generally cylindrical hull orifice 88 is provided through hull 82. Hull drain valve 80 has a drain hole coupling 12 that has a cylinder 14 with a flange 18 at one end and an opposing distal end 20. Cylinder 14 also has an exterior wall 16. A portion of the exterior wall 16 of cylinder 14 is fabricated with external threads 22. The threads 22 extend from the distal end 20 of cylinder 14 toward the flange 18 to a point 24 near flange 18. Drain hole coupling 12 is inserted into hull orifice 88 such that flange 18 rests against exterior surface 84 of hull 82. A nut 30, with a contact side 32 and a back side 34 is threaded onto the external threads 22. The contact side 32 of the nut 30 is tightened against the interior surface 86 of the hull with sufficient pressure to prevent water leakage between the hull orifice 88 and the exterior wall 16 of the cylinder 14. Note that in this embodiment it is important that point 24, where threads 22 terminate, be between the interior surface 86 and the exterior surface 84 of the hull 82 when drain hole coupling 12 is attached to the hull 82. If needed to ensure a water leak proof connection, a gasket, washer, or sealer can be installed between the contact side 32 of nut 30 and the interior surface 86 of hull 82, or between flange 18 and exterior surface 84 of hull 82, or between exterior wall 16 of cylinder 14 and hull orifice 88.

Continuing with FIG. 5, a ball valve 40, having a threaded end 42 is threaded onto the threads 22 of drain coupling 12. Ball valve 40 has a ball actuator 44 which, as previously discussed, opens and closes ball valve 40. A handle 60 has an extension 62 and a grip 70. Extension 62 has a proximal end 64 and a distal end 66. The proximal end 64 is attached to the ball actuator 44 and the grip 70 is attached to the distal end 66 of the extension 62. The handle 60 forms a inverted "L" shape. Typically an extension 62 has a length 68 from about six inches to eighteen inches.

Figure 6:
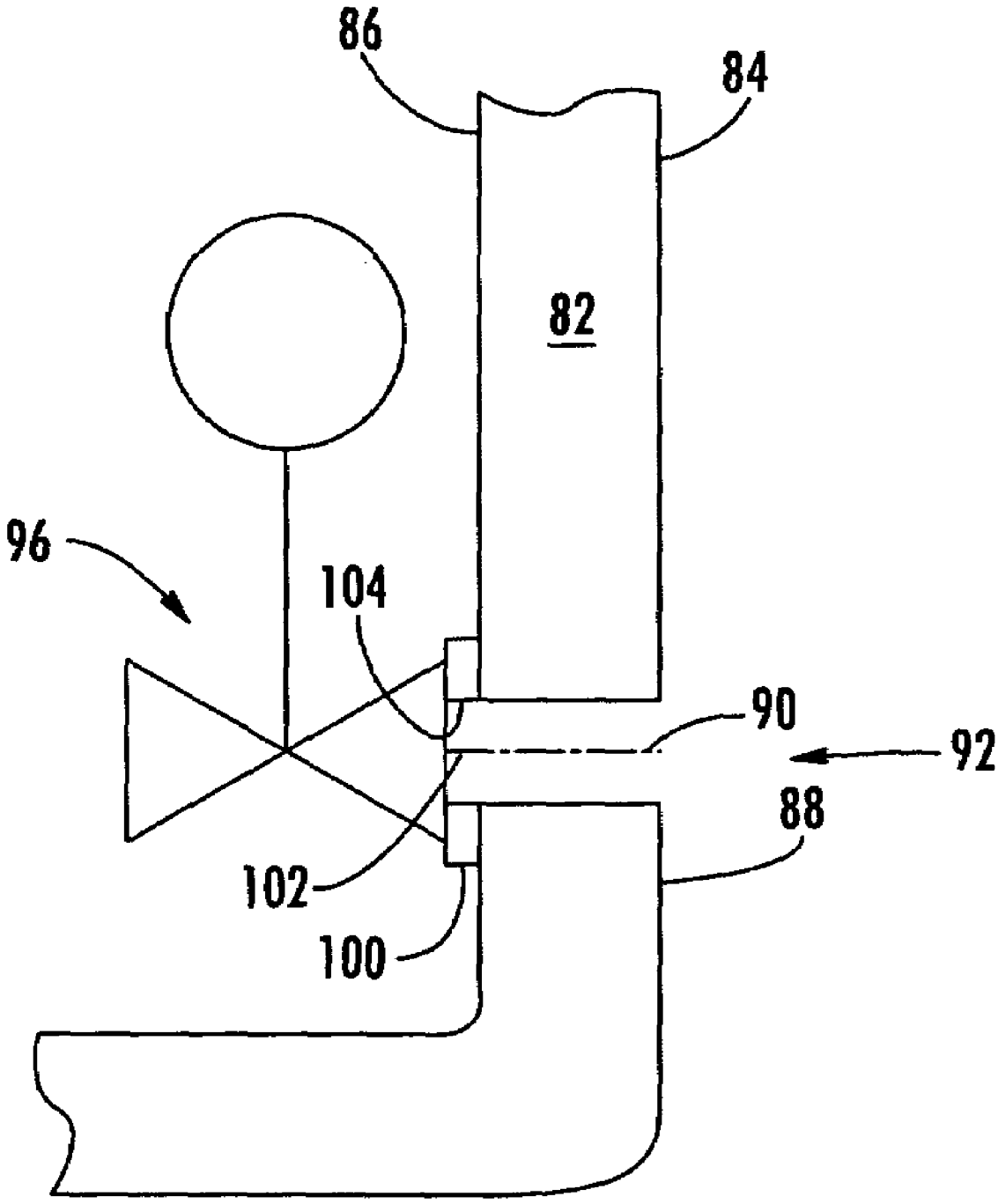
FIG. 6 is a schematic diagram of an alternate embodiment of a boat drain valve according to the invention.

FIG. 6 presents a schematic illustration of an alternate embodiment. A valve 96 is shown attached to hull 82 by a fastening system 100. Fastening system 100 typically comprises mechanical elements such as threaded fasteners (e.g., drain hole coupling 12 of FIG. 1), or adhesives, soldered joints, press fit members, or similar connections. In the embodiment of FIG. 6, fastening system 100 has a longitudinal axis 102 and an aperture 104. Hull 82 has an exterior surface 84 and an interior surface 86, and there is a generally cylindrical orifice 88 through hull 82. Orifice 88 has a longitudinal orifice axis 90 and a orifice profile 92. It is important that the fastening system 100 provide a water leak proof connection between valve 96 and hull 82, such that all water flowing from outside hull 82 through hull orifice 88 passes only through valve 96. In preferred embodiments, longitudinal axis 102 of fastening system 100 is substantially coaxial with longitudinal axis 90 of orifice 88. If fastening system 100 is constructed to be contained entirely within the interior surface 86 of the hull 82, then in preferred embodiments aperture 104 of fastening system 100 is substantially congruent with orifice profile 92. However, in come embodiments, the fastening system 100 has a member that extends into hull orifice 88. An example of that is drain coupling 12 depicted in FIG. 5. In such embodiments congruency is not relevant and only the coaxiality of axis 90 and axis 102 is important.

Valve 96, shown symbolically in FIG. 6, is characterized as having a generally cylindrical valve throat with a throat profile and a longitudinal throat axis that creates a passageway through the valve. Valve 96 also has a valve barrier (shown symbolically as the crossing point of the "X" in the symbol). Mechanically, in most embodiments, the valve barrier is designed to be proximal to the valve throat. In preferred embodiments, the longitudinal throat axis of valve 96 is substantially coaxial with the longitudinal axis 102 of the fastening system 100 and the longitudinal axis 90 of orifice 88. The valve barrier has an open position and a closed position. When the valve barrier is in the open position the passageway in the valve throat passes water and when the valve barrier is in the closed position the passageway in the valve throat is essentially water tight. A valve actuator (shown symbolically as the circle with a stem) is linked to the valve barrier such that the valve actuator switches the valve barrier to and from its open and closed positions. In a most preferred embodiment, when the valve barrier is in its open position, the throat profile and the fastening system aperture 104 are substantially congruent, and form a straight channel that is substantially unobstructed. In a most preferred embodiment, when the valve barrier is in its closed position the straight channel is substantially water tight. The valve actuator may be a manual mechanical linkage such as handle coupled to a valve stem, or the valve actuator may be a powered linkage such as an electric motor coupled to a valve stem.

Figure 7:
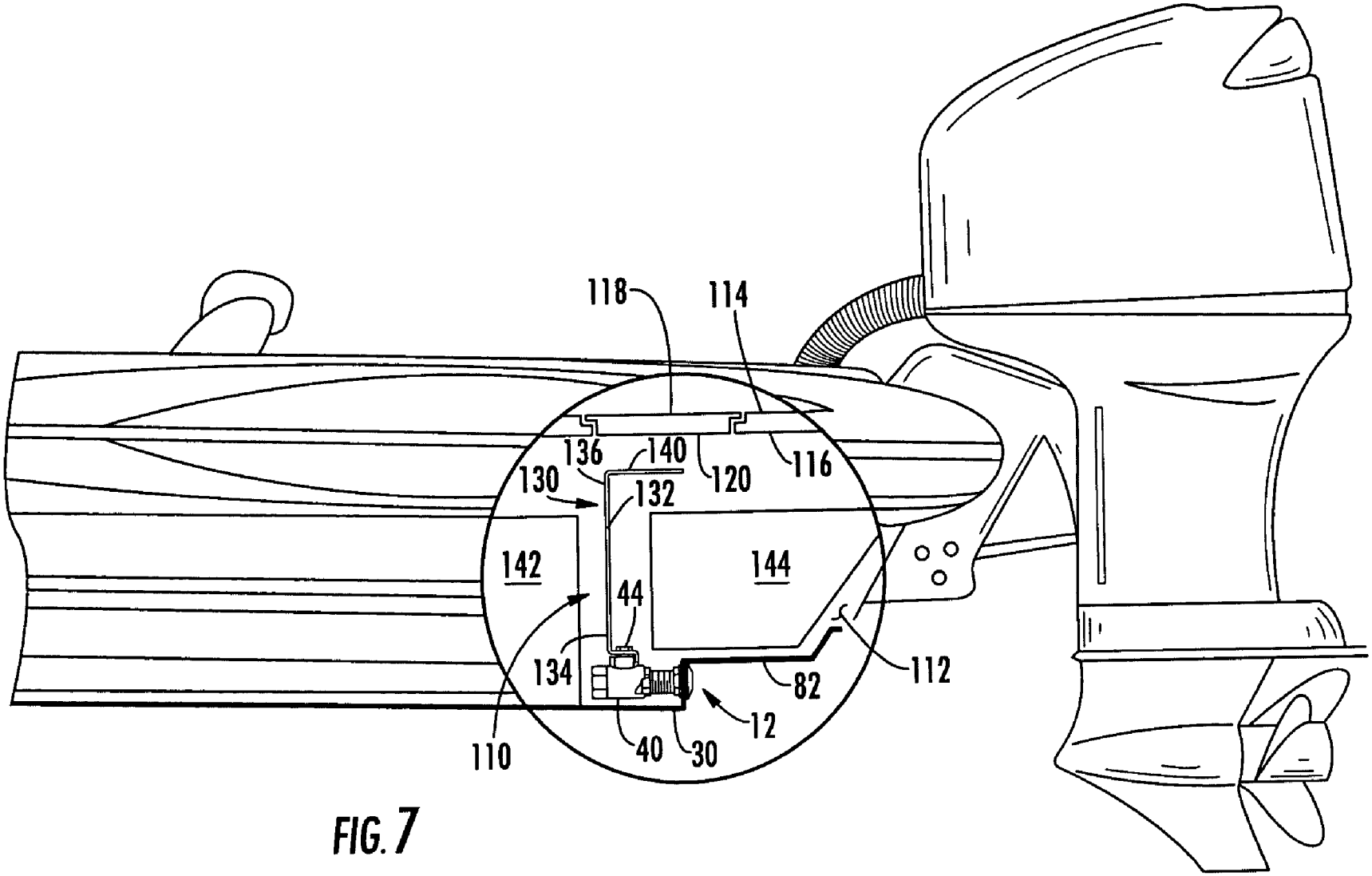
FIG. 7 is an elevational view of an alternate embodiment of a boat drain valve according to the invention.

A further alternate embodiment is illustrated in FIG. 7, where under-hatch drain valve 110 is depicted. A deck 114 is set in the boat hull 82, and the deck has a bottom surface 116. A hatch 118 is set in the deck 114, and the hatch has a bottom surface 120. The hull 82 substantially defines the bottom and sides of a compartment 112. The bottom surface 120 of the hatch 118 and the bottom surface 116 of the deck 114 substantially define the top of compartment 112. Items such as operational equipment 142 and 144 are frequently installed in compartment 112. Operational equipment 142 may, for example, be safety equipment such as life vests, a fire extinguisher, or a spare battery. Operational equipment 144 may, for example, include a live well, an anchor container, a tackle box, etc. In this embodiment, drain hole coupling 12 is attached to hull 82 with nut 30, and ball valve 40 is attached to drain hole coupling 12, all in the manner depicted in FIG. 5. Ball valve 40 incorporates a ball actuator 44. Typically, a handle 130 with an extension 132 and a grip 140 is used. The extension 132 has a proximal end 134 that is attached to ball actuator 44 and grip 140 is attached to distal end 136 of the extension 132. The handle 130 forms a inverted "L" shape. The length of extension 132 is selected to be sufficient to position the grip 140 at a point above the operating equipment (e.g., 144) such that the operating equipment (e.g. 144) does not mechanically interfere with the grip 140 as the ball valve 40 is changed from the open position to the closed position, but where the position of the grip 140 is below the bottom surface 120 of the hatch 118.

Figure 8:
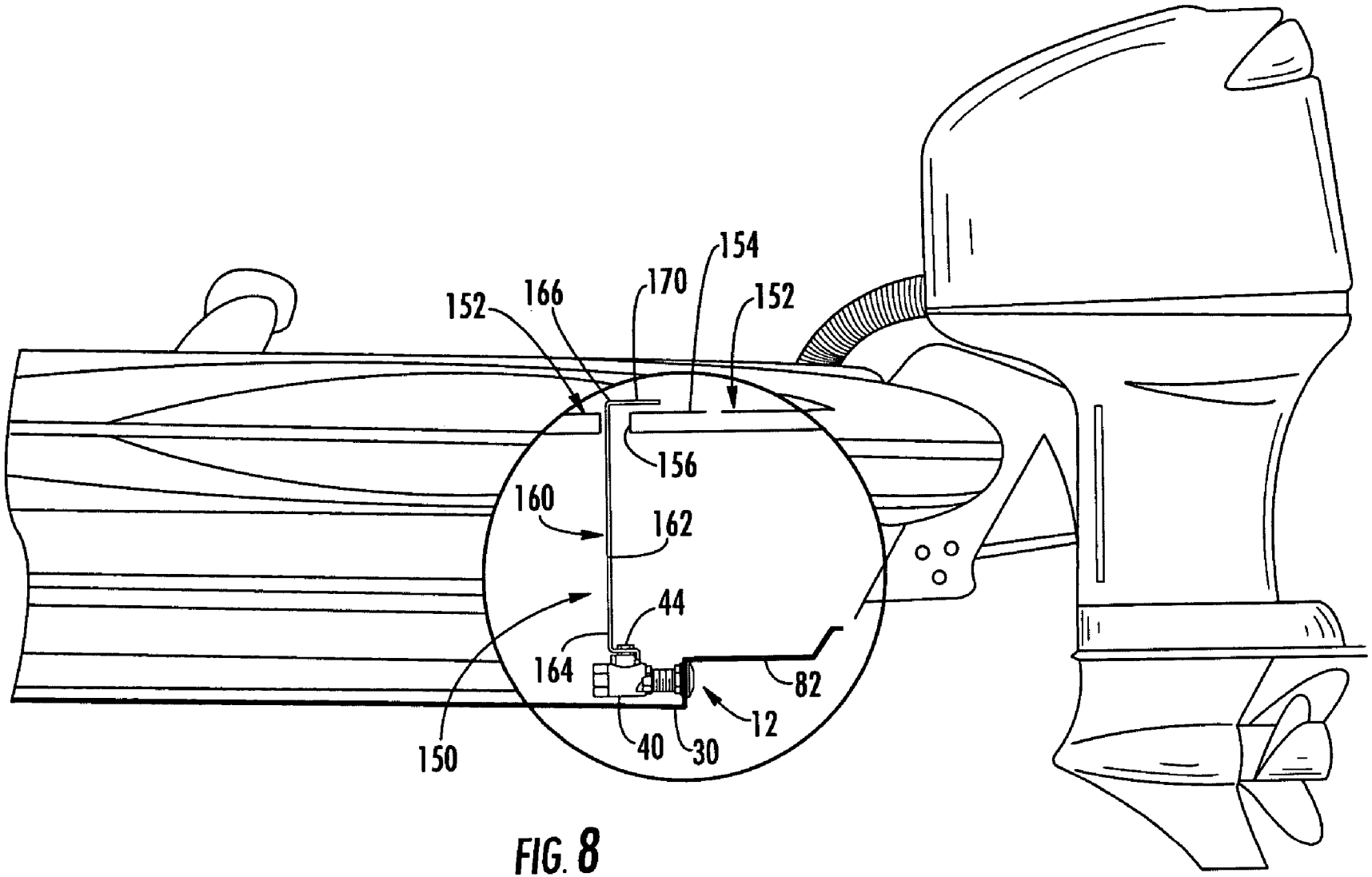
FIG. 8 is an elevational view of an alternate embodiment of a boat drain valve according to the invention.

An alternate embodiment of a boat drain valve, under-deck drain valve 150, is depicted in FIG. 8. A deck 152 is set in the boat hull 82, and the deck has a top surface 154. An access port 156 is provided in deck 152. In this embodiment, drain hole coupling 12 is attached to hull 82 with nut 30, and a ball valve 40 is attached to drain hole coupling 12, all in the manner depicted in FIG. 5. Ball valve 40 incorporates a ball actuator 44. Typically a handle 160 with an extension 162 and a grip 170 is used. The extension 162 has a proximal end 164 that is attached to ball actuator 44 and grip 170 is attached to distal end 166 of the extension 162. The handle 160 forms a inverted "L" shape. Extension 162 passes through access port 154. The length of extension 162 is selected to be sufficient to position the grip 170 at a point above the top surface 154 of deck 152.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A boat drain valve system comprising;

a boat hull having an exterior and an interior surface and a generally cylindrical hull orifice from said exterior surface to said interior surface;

a compartment having a bottom and sides that are formed substantially by said boat hull and having a deck on top, and where said compartment has an access provided through a hatch on said deck, and where said hatch has a bottom surface exposed to said compartment;

operational equipment in said compartment;

a valve having a valve throat with a passageway and a valve barrier proximal to said valve throat wherein said valve barrier has an open position and a closed position such that when said valve barrier is in said open position said passageway passes water and when said valve barrier is in said closed position said passageway is substantially water tight;

a fastening system that comprises an aperture and provides a water leak proof connection between said valve and said hull orifice;

a valve actuator linked to said valve barrier whereby said valve actuator switches said valve barrier to and from said open position and said closed position; and a handle comprising an extension and a grip, with said extension having a proximal end, a length, and a distal end and where said proximal end of said extension is attached to said valve actuator and said grip is attached to said distal end of said extension and where said length of said extension is sufficient to position said grip at a point above said operating equipment such that said operating equipment does not mechanically interfere with said grip as said valve barrier is changed from said open position to said closed position and where said grip is below said bottom surface of said hatch.

2. The boat drain valve of claim 1 wherein said hull orifice. said throat passageway and said aperture form a substantially straight channel.

3. The boat drain of claim 1 wherein said handle is substantially an inverted "L" shape.

4. The boat drain valve system of claim 1 wherein said grip on said handle further comprises a position indicator indicating whether said valve barrier is in said open position or in said closed position.

* * * * *